United States Patent [19]

Mori

[11] 4,424,611

[45] Jan. 10, 1984

[54] BUCKLE FOR WATCH BANDS

[75] Inventor: Yoshinobu Mori, Tanashi, Japan

[73] Assignee: Citizen Watch Co., Ltd., Tokyo, Japan

[21] Appl. No.: 328,145

[22] Filed: Dec. 7, 1981

[30] Foreign Application Priority Data

Dec. 17, 1980 [JP] Japan ..... 55-181545[U]

[51] Int. Cl.[3] ..... A44C 5/08

[52] U.S. Cl. ..... 24/192; 24/327; 24/241 SP; 24/265 WS; 24/71 J

[58] Field of Search ..... 24/68 J, 71 J, 240, 24/241 S, 241 P, 241 PP, 241 SP, 248 B, 265 WS, 265 BC, 265 EC, 327, 343, 375, 376, 192; 63/3, 4; 224/163, 164, 166, 168

[56] References Cited

U.S. PATENT DOCUMENTS

| | | | |
|---|---|---|---|
| 2,401,297 | 6/1946 | Forstner | 24/265 WS |
| 3,478,537 | 11/1969 | Golberine et al. | 24/265 WS |
| 3,555,850 | 1/1971 | Bello | 24/71 |
| 4,147,285 | 4/1979 | Bobrick | 24/265 WS |
| 4,270,249 | 6/1981 | Meyerson et al. | 24/241 PP |
| 4,314,389 | 2/1982 | Sauer et al. | 24/376 |
| 4,332,061 | 6/1982 | Rieth et al. | 24/265 WS |
| 4,345,444 | 8/1982 | Gay | 24/265 WS |

*Primary Examiner*—Gene Mancene
*Assistant Examiner*—David I. Tarnoff
*Attorney, Agent, or Firm*—John T. Roberts; Richard H. Stern

[57] ABSTRACT

A buckle for watch bands comprising three folding members. The members are a clasping member connected to an end of one of the watch bands, a middle plate rotatably connected to the clasping member at one end thereof, and a bottom plate rotatably connected to the other end of the middle plate and connected to one end of the other band. The clasping member and the bottom plate are engaged with each other by an engaging means. A lock member is rotatably supported on the clasping member. A primary hook portion is provided on the lock member, and a secondary hook portion is provided on the bottom plate. The primary hook portion is adapted so as to engage with the secondary hook portion by rotating the lock member when the buckle is in folded state.

4 Claims, 9 Drawing Figures

BUCKLE FOR WATCH BANDS

BACKGROUND OF THE INVENTION

The present invention relates to a buckle for watch bands, and more particularly to a triple-fold type buckle having a double-lock structure.

Generally, the watch band with the triple-fold type buckle is widely used because of its ease of wearing and removing. However, if the buckle or watch band is subjected to a great force, the buckle is easily disengaged at the engaging portion, and stretched resulting in the watch falling off.

Especially, a dangerous situation would arise should a diver lose his watch in the water by accident, for example, if the watch strikes a rock. Accordingly, development of a secure buckle has been long awaited.

SUMMARY OF THE INVENTION

An object of the present invention is to provide a buckle offering secure engagement with double-lock structure.

According to the present invention, there is provided a buckle for watch bands comprising a clasping member connected to one end of one of the watch bands, a middle plate rotatably connected to said clasping member at one end thereof, a bottom plate rotatably connected to the other end of said middle plate and connected to an end of the other band, engaging means for engaging said clasping member with said bottom plate, a lock member rotatably supported on said clasping member, a primary engaging portion formed on said lock member, and a secondary engaging portion formed on said bottom plate, said primary engaging portion being adapted to be engaged with said secondary engaging portion by rotating said lock member in folded state of said buckle.

These and other objects and features of the present invention will become more apparent from the following description with reference to the accompanying drawings.

DESCRIPTION OF THE PREFERRED EMBODIMENTS

Figure 1:
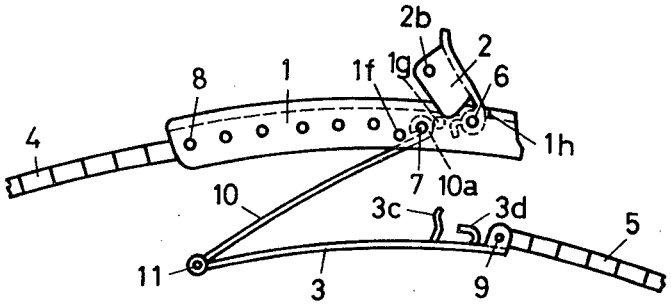
FIG. 1 is a side view showing a buckle according to the present invention in disengaged state.

Referring to the drawings, the buckle of the present invention comprises a clasping member 1 connected to a watch band 4, a lock member 2 mounted on the clasping member 1, a bottom plate 3 connected to another watch band 5, and a middle plate 10 connected to the clasping member 1 and bottom plate 3.

Figure 3A:
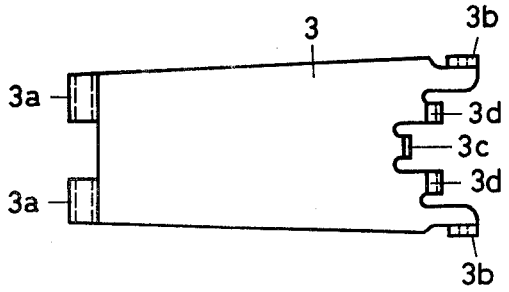
FIG. 3*a* is a plan view of a bottom plate.
Figure 3B:
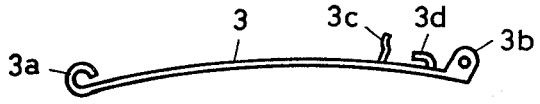
FIG. 3*b* is a side view of the bottom plate.

Referring to FIG. 3, the bottom plate 3 comprises a pair of rounded portions 3*a* provided at one end portion thereof, and a pair of arms 3*b* projecting from both sides at the other end portion thereof. Each of arms 3*b* has a pin hole for securing a lateral pin 9. The rounded portions 3*a* are rotatably mounted on a lateral pin 11 to be engaged with the middle plate 10 and arms 3*b* are rotatably connected with the watch band 5 by the pin 9. A pair of hook portions 3*d* is provided adjacent to arms 3*b* and a snap engaging projection 3*c* is provided between hook portions 3*d*. Each hook portion has an engaging portion extending in parallel with the bottom plate 3.

Figure 4A:
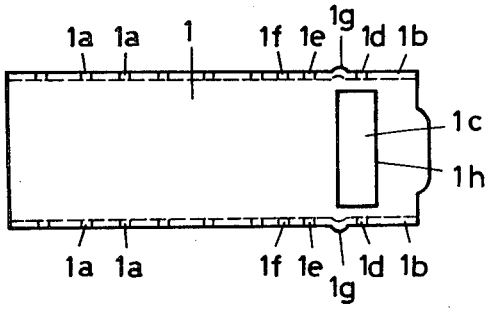
FIG. 4*a* is a plan view of a clasping member.
Figure 4B:
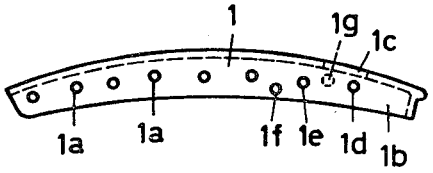
FIG. 4*b* is a side view of the clasping member.

Referring to FIG. 4, the clasping member 1 comprises a pair of side walls 1*b* and an opening 1*c* formed in the top plate thereof. Each side wall 1*b* has a series of adjusting holes 1*a* to adjust the effective length of the watch band 4, a pin hole 1*d* for connecting the lock member 2, a pin hole 1*e* for connecting the middle plate 10, an engaging hole 1*f* for engaging with a protuberance 2*b* of the lock member 2, and a protuberance 1*g* for maintaining the lock member 2 in open state.

Figure 5A:
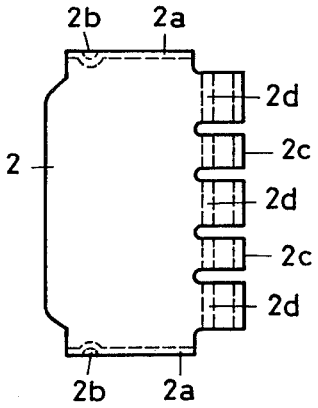
FIG. 5*a* is a plan view of the lock member.
Figure 5B:
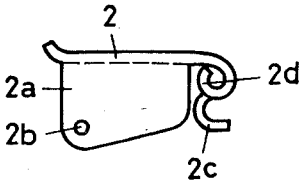
FIG. 5*b* is a side view of the lock member.

Referring to FIG. 5, the lock member 2 comprises a pair of side walls 2*a* each havng a protuberance 2*b*, and hook portions 2*c* and rounded portions 2*d* which are alternately provided at one end portion thereof. The protuberance 2*b* is inwardly projected from the side wall 2*a*.

Figure 2A:
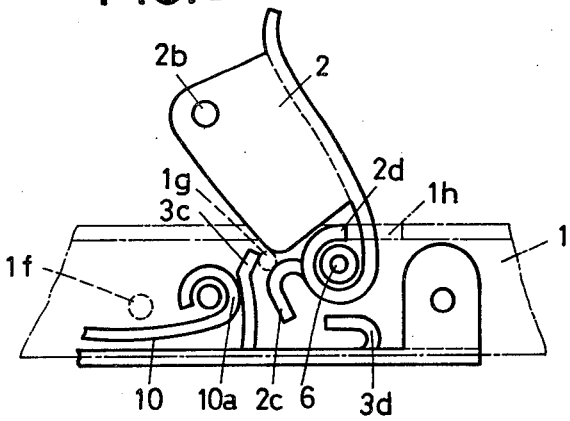
FIG. 2*a* is an enlarged side view showing a part of the buckle in folded state in which a lock member is disengaged.
Figure 2B:
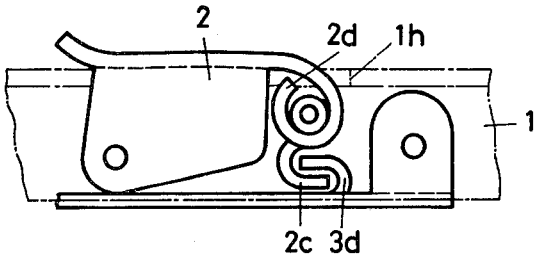
FIG. 2*b* is an enlarged side view showing a part of the buckle similar to FIG. 2*a*, in which the lock member is engaged.

Referring to FIGS. 1 and 2, rounded portions 2*d* of the lock member 2 are inserted into the opening 1*c* of the clasping member 1 and rotatably mounted on a lateral pin 6 which is engaged with pin holes 1*d*. The clasping member 1 is connected to the watch band 4 by a pin 8 at a selected adjusting hole 1*a*. The middle plate 10 is rotatably connected to the clasping member 1 by a lateral pin 7 engaged with the hole 1*e*. The snap engaging projection 3*c* is adapted to engage with a rounded portion 10*a* of the middle plate 10 so that the clasping member 1 and the bottom plate 3 are engaged with each other.

Describing the use of the buckle, the snap engaging projection 3*c* of the bottom plate 3 is removed from the rounded portion 10*a* of the middle plate 10 to permit the buckle to be expanded. The bottom plate 3 and middle plate 10 are stretched and the bands clasp the wrist of the wearer. The snap engaging portion 3*c* is engaged with the rounded portion 10*a* to tighten the bands. Then, the lock member 2 is rotated about the pin 6 in the counterclockwise direction in FIG. 2*a* until protuberances 2*b* engage with engaging holes 1*f* respectively. In this position, hook portions 2*c* are parallel with the hook portions 3*d* and engaged with hook portions 3*d* to secure the engagement of the lock member 2. It is possible to modify the construction into such a design that the hook portion 2*c* may be directly engaged with the lateral pin 9 by changing the position of the lateral pin 6 for the lock member 2.

In order to remove the watch band, the operation is carried out in the reverse order.

In the open state of the lock member 2, the outer wall of the lock member 2 is engaged with a stopper portion 1*h* of the opening 1*c* of the clasping member 1 and is supported on protuberances 1*g* of the clasping member 1 so that the lock member 2 is maintained between the stopper portion 1*h* and the protuberances to prevent unstable movement of the lock member. Therefore, manipulation for engagement of the clasping member with the bottom plate 3 is easily done.

From the foregoing, it is apparent that the present invention provides a buckle with a double-lock structure without significantly altering the appearance and structure of the triple-fold type buckle. Further, since the lock member is held in the open state, a buckle having excellent operability can be provided.

What is claimed is:

1. A buckle for a watch band having two ends comprising:

(a) a clasping member having a top plate, a first end of said clasping member connected to the first end of said band, a second end and an opening formed in said top plate adjacent said second end;

(b) a middle plate rotatably connected to said second end of said clasping member;

(c) a bottom plate having a first end rotatably connected to said middle plate and a second end connected to the second end of said watch band;

(d) a first engaging means for engaging and securing said clasping member to said bottom plate;

(e) a second engaging means for engaging and securing said clasping member to said bottom plate;

(f) said second engaging means comprising a lock member rotatably mounted on said clasping member at a position adjacent the second end of said clasping member;

(g) a hook portion formed on said lock member;

(h) a hook portion on said bottom plate adjacent said second end of said bottom plate;

(i) said hook portion on said bottom plate being parallel with said bottom plate;

(j) said hook portion on said lock member passing through said opening and engaging said hook portion on said bottom plate when said lock member is rotated in one direction;

(k) said hook portion on said lock member being parallel with said bottom plate when rotated in said direction;

whereby relative rotation between said middle plate and said bottom plate is prevented.

2. A buckle for watch bands according to claim 1 wherein said clasping member has opposite side walls each having a series of adjusting holes for connecting with the end of said band.

3. A buckle for watch bands according to claim 2 further comprising a third engaging means provided on said lock member and said side walls for maintaining said lock member in the closed position.

4. A buckle for watch bands according to claim 3 further comprising a fourth engaging means provided on said side plates of said clasping member for supporting said lock member in an open state, and said opening of said clasping member having a stopper portion for limiting rotation of said lock member in the opening direction.

* * * * *